US005411458A

United States Patent [19]

Giust

[11] Patent Number: 5,411,458

[45] Date of Patent: May 2, 1995

[54] ANGLED TRACK SQUAT EXERCISE APPARATUS

[76] Inventor: Jeffrey Giust, 16 Rooney St., Clifton, N.J. 07011

[21] Appl. No.: 215,819

[22] Filed: Mar. 22, 1994

[51] Int. Cl.[6] ..... A63B 21/06; A63B 23/04

[52] U.S. Cl. ..... 482/101; 482/134; 482/135; 482/142

[58] Field of Search ..... 482/92–103, 482/133–135, 142

[56] References Cited

U.S. PATENT DOCUMENTS

| | | | |
|---|---|---|---|
| 1,621,477 | 3/1927 | Pilates | 482/135 |
| 2,733,922 | 2/1956 | Diego | 482/96 |
| 2,783,045 | 2/1957 | Bosch | 482/135 |
| 3,130,968 | 4/1964 | De Feen | 482/135 |
| 3,219,341 | 11/1965 | Weinstein | 482/96 |
| 3,235,255 | 2/1966 | Leflar | 482/104 |
| 4,176,836 | 12/1979 | Coyle | 482/96 |
| 4,316,082 | 2/1982 | Lundberg | 482/94 |
| 4,333,644 | 6/1982 | Lambert et al. | 482/135 |
| 4,535,985 | 8/1985 | Mask | 482/94 |
| 4,666,151 | 5/1987 | Chillier | 482/135 |
| 4,700,946 | 10/1987 | Breunig | 482/96 |
| 4,706,953 | 11/1987 | Graham | 482/96 |
| 4,720,103 | 1/1988 | Palladino, Jr. | 482/112 X |
| 4,826,154 | 5/1989 | Askonen | 482/101 |
| 4,828,252 | 5/1989 | Bowen et al. | 482/94 |
| 4,890,830 | 1/1990 | Kern | 482/98 |
| 4,930,769 | 6/1990 | Nenoff | 482/96 |
| 5,056,777 | 10/1991 | Capjon et al. | 482/101 |
| 5,066,005 | 11/1991 | Luecke | 482/96 |

*Primary Examiner*—Richard J. Apley
*Assistant Examiner*—John Mulcahy
*Attorney, Agent, or Firm*—Anthony F. Cuoco

[57] ABSTRACT

Horizontal squat exercise apparatus includes a substantially horizontally disposed base frame. The base frame supports at its front a substantially vertically disposed foot plate frame and supports at its rear a substantially vertically disposed weight rack frame carrying a plurality of selectable weights. A track frame is supported on the base frame between the foot plate frame and the weight rack frame and includes a substantially horizontal section and a section inclined downwardly from the horizontal section toward the front of the base frame. A carriage is supported on the track frame so as to be displaced first upwardly along the inclined section and then along the horizontal section by an exerciser pushing with his/her feet against the foot plate frame. Selected weights are arranged to be lifted in the weight rack as the carriage is so displaced.

13 Claims, 6 Drawing Sheets

ANGLED TRACK SQUAT EXERCISE APPARATUS

BACKGROUND OF THE INVENTION

This invention relates to apparatus for exercising the thigh and gluteal regions of the human body. More particularly, this invention relates to apparatus for exercising the aforementioned bodily regions while reducing the risk of injury to the back and knees.

An exercise for the purposes described is known as the squat exercise. The squat exercise is usually performed with the exerciser lifting a barbell and weights and gradually descending from a standing position to a squat position. When performing the exercise as described the back of the exerciser does not remain straight, i.e. vertical, as the exerciser descends. Actually, the angle of the back from the vertical increases as the descent increases.

Prior art apparatus for performing the squat exercise of which the present inventor is aware tends to inhibit this "angling" of the exerciser's back, thereby putting undue pressure on the exerciser's knees. This is illustrated by considering, for example, an exerciser standing with the back against a wall and the feet at shoulder width. As the squat exercise commences, the back is kept flat against the wall until the thighs are parallel with the floor. Upon pushing up, keeping the back against the wall, excessive pressure is exerted on the knees which among other things tends to unbalance the exerciser.

The present invention overcomes this disadvantage by allowing the exerciser's back to angle, thereby offering better balance with significantly less pressure on the knees.

SUMMARY OF THE INVENTION

This invention contemplates squat exercise apparatus including a substantially horizontally disposed base frame having front and rear ends. The front end supports a substantially vertical foot plate frame which is displaceable away from and toward the front end and is locked in a desired displaced position. The rear end supports a weight rack frame carrying a plurality of selectable weights. A track frame is supported on the base frame between the foot plate frame and the weight rack frame and extends above the base. The track frame includes a substantially horizontal section in spaced relation to the weight rack frame and a section in spaced relation to the foot plate frame and in downwardly inclined relation to the horizontal section. A carriage is supported on the track frame so as to be displaced therealong by an exerciser pushing against the foot plate frame. As the carriage is displaced upwardly along the inclined section and then along the horizontal section selected weights are lifted along the weight rack frame via a sprocket and chain arrangement. The carriage is prevented from rolling all the way down the inclined section by a restraining cable secured to the bottom of the carriage and to the track frame for preventing injury to an exerciser which might otherwise occur when using free weights.

DETAILED DESCRIPTION OF THE INVENTION

Figure 1A:
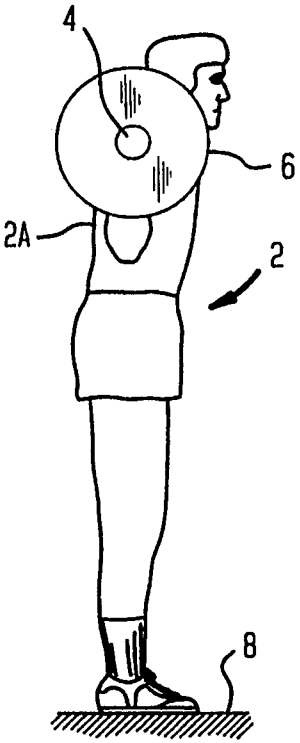
FIG. 1A (PRIOR ART)
FIGS. 1A, 1B and 1C are diagrammatic representations illustrating the squat exercise as performed according to the prior art, i.e. an exerciser using a barbell with weights.
Figure 1B:
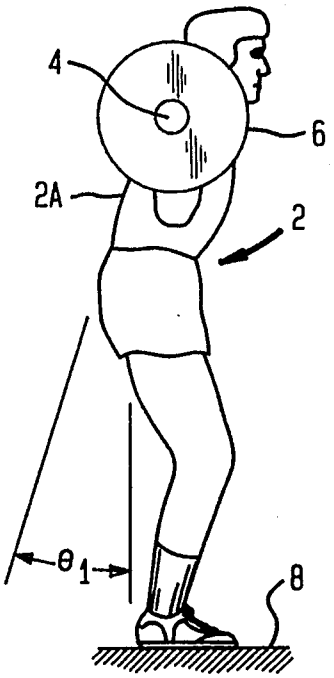
FIG. 1B (PRIOR ART)
Figure 1C:
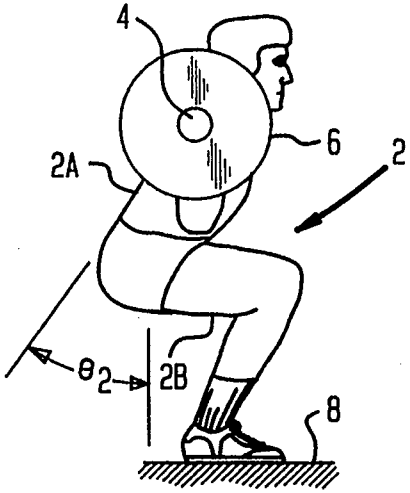
FIG. 1C (PRIOR ART)

A squat exercise is performed in accordance with the prior art as shown in FIGS. 1A, 1B and 1C. An exerciser 2 lifts a barbell 4 carrying weights 6 and initially stands in an upright position. The exerciser's back 2A is substantially straight or vertical as shown in FIG. 1A. It will be understood that the squat exercise can be performed with or without weights and will be described herein for purposes of illustration as being performed with weights.

The squat exercise progresses when exerciser 2 begins to descend by bending the legs at the knees. The exerciser's back deviates from the vertical by the angle $\Theta_1$. A particular intermediate position of the exerciser performing the squat exercise is shown in FIG. 1B.

The squat exercise progresses until the exerciser's thighs 2B are substantially parallel to a supporting surface 8 on which the exerciser stands. With the thighs in this position, the angle of the exerciser's back 2A from the vertical increases to $\Theta_2$. In properly performing the squat exercise, angle $\Theta_2$ is approximately 35 degrees.

Thus, when performing the squat exercise in accordance with the prior art, the exerciser's back does not remain straight (vertical) as the exerciser descends. The exerciser's back actually tends to increase in angularity from the vertical as the exerciser's descent progresses. The present invention accommodates this advantageous situation.

The present invention is also advantageous over the prior art as shown in FIGS. 1A, 1B and 1C in that the risk of injury to the exerciser's back and knees is greatly reduced because the present invention supports the exerciser's back. Moreover, a safety factor is involved in the present invention to the extent that the exerciser will not have to try to balance weights 6 on barbell 4 or risk tripping on some object when trying to put the barbell back on a rack. Further, the exerciser will not have to be concerned about being stuck in the fully descended (squat) position (FIG. 1C) or having an injury occur.

Figure 2:
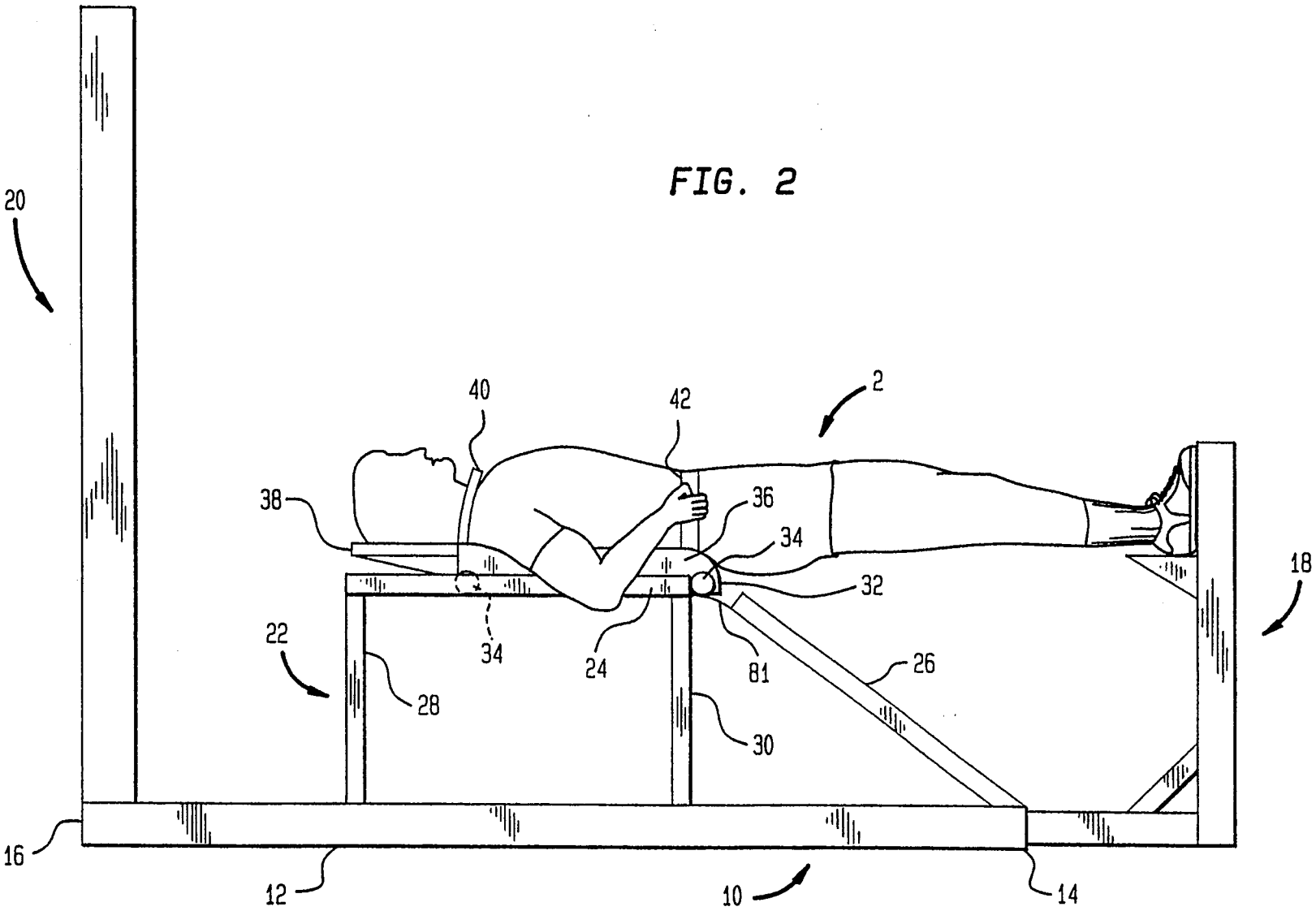
FIG. 2 is a diagrammatic representation generally illustrating apparatus according to the invention and showing an exerciser disposed thereon as in one stage of a squat exercise.
Figure 3:
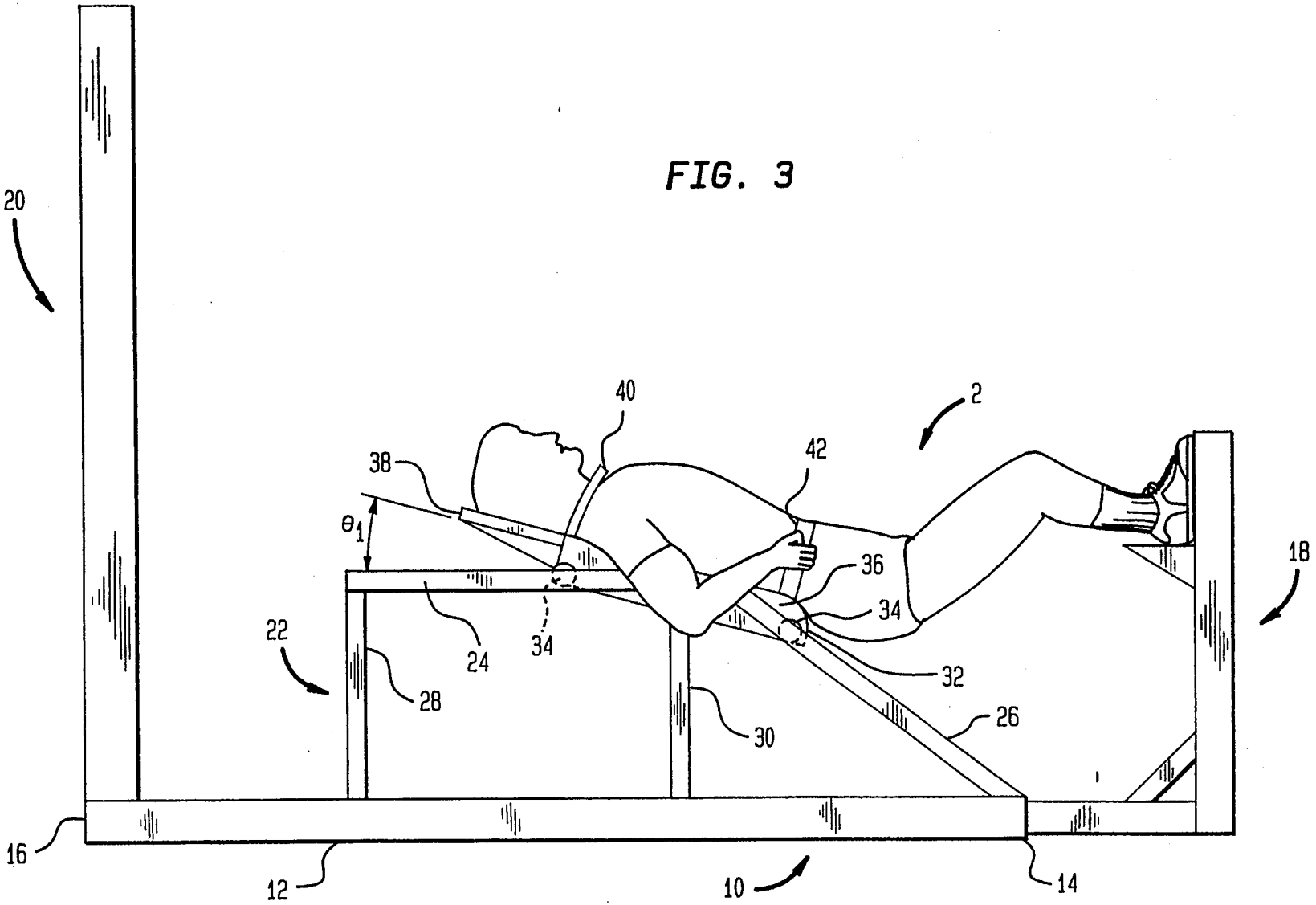
FIG. 3 is a diagrammatic representation illustrating the exerciser disposed on the apparatus of the invention as in another stage of the squat exercise.
Figure 4:
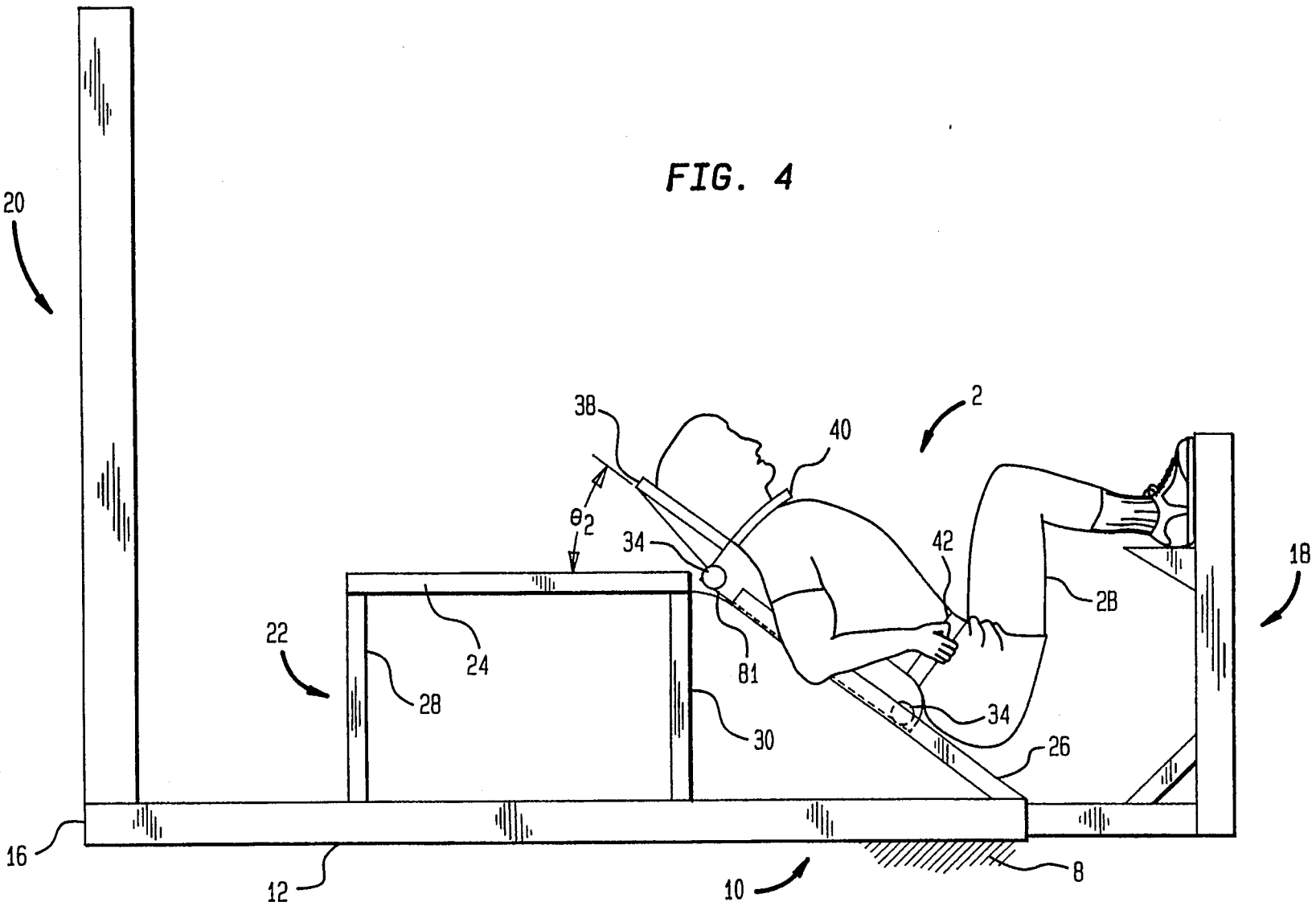
FIG. 4 is a diagrammatic representation illustrating the exerciser disposed on the apparatus of the invention as in yet another stage of the squat exercise.

The apparatus of the invention is shown generally in FIGS. 2, 3 and 4 and is designated by the numeral 10. Apparatus 10 includes a base frame 12 having a front end 14 and a rear end 16. A foot plate frame 18 is supported by base frame 12 at front end 14 thereof so as to be displaceable away from and toward front end 14. A weight rack 20 is supported on rear end 16 of base frame 12.

A track frame 22 is supported on base frame 12 and includes a horizontal track section 24 and a track section 26 inclined relative to horizontal track section 24. Horizontal track section 24 is supported by support members 28 and 30 so as to extend above base frame 12. Inclined track section 26 extends downwardly from the horizontal track section to the front end 14 of base frame 12.

A carriage 32 is supported by rollers such as 34 so as to ride in track sections 24 and 26.

Carriage 32 supports a cushion 36 for supporting the upper torso of exerciser 2. A headrest 38 extends from the rear of carriage 32. A pair of shoulder bars 40 are secured to Carriage 36 on each side thereof. A strap or belt 42 extends around carriage 36 to secure exerciser 2 on the apparatus of the invention.

Base frame 12, weight rack 20, foot plate frame 18, track frame 22 and carriage 32 will be more fully described with reference to FIGS. 5, 6 and 7.

As particularly shown in FIG. 2, operator 2 is positioned on squat exercise apparatus 10 in a substantially horizontal position. The exerciser's legs are extended and the exerciser's back is straight. Except for the exerciser lying on his/her back, the exerciser is oriented as indicated in FIG. 1A.

With reference now to FIG. 3, carriage 32 is displaced first along horizontal track section 24 and then inclined track section 26. The exerciser's legs are bent at the knees and the exerciser's back is at an angle $\Theta_1$ from the horizontal. Except for the fact that exerciser 2 is lying on his/her back, the exerciser is oriented as particularly shown in FIG. 1B.

When carriage 32 is in a position as particularly shown in FIG. 4, the exerciser's back is at an angle $\Theta_2$ from the horizontal and the exerciser's thighs 2B are substantially normal to supporting surface 8. Except for the fact that the exerciser is lying on his/her back, the exerciser is oriented as shown in FIG. 1C.

Figure 7:
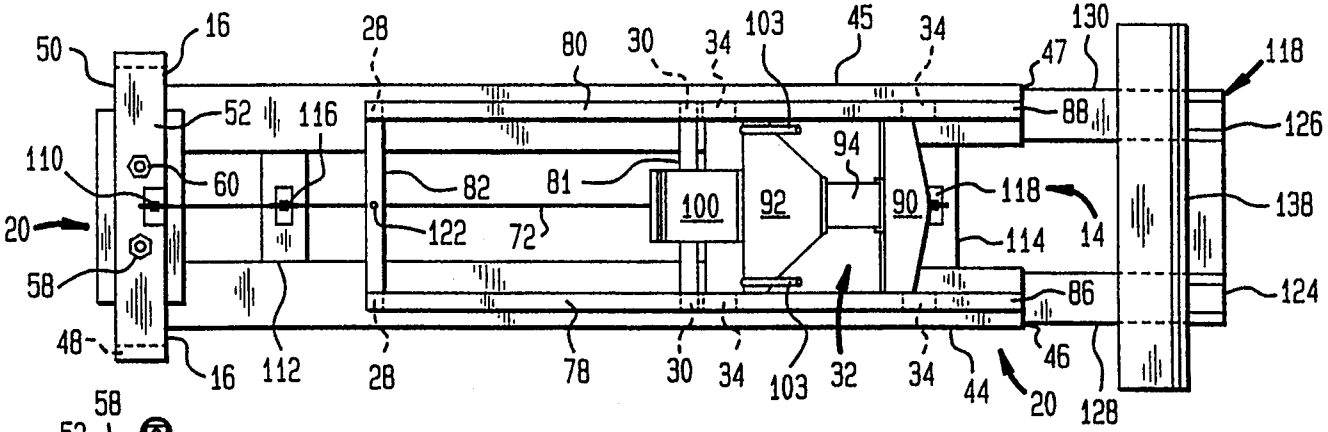
FIGS. 5, 6 and 7 are side, front and top views, respectively, showing the apparatus of the invention in substantial detail.
Figure 5:
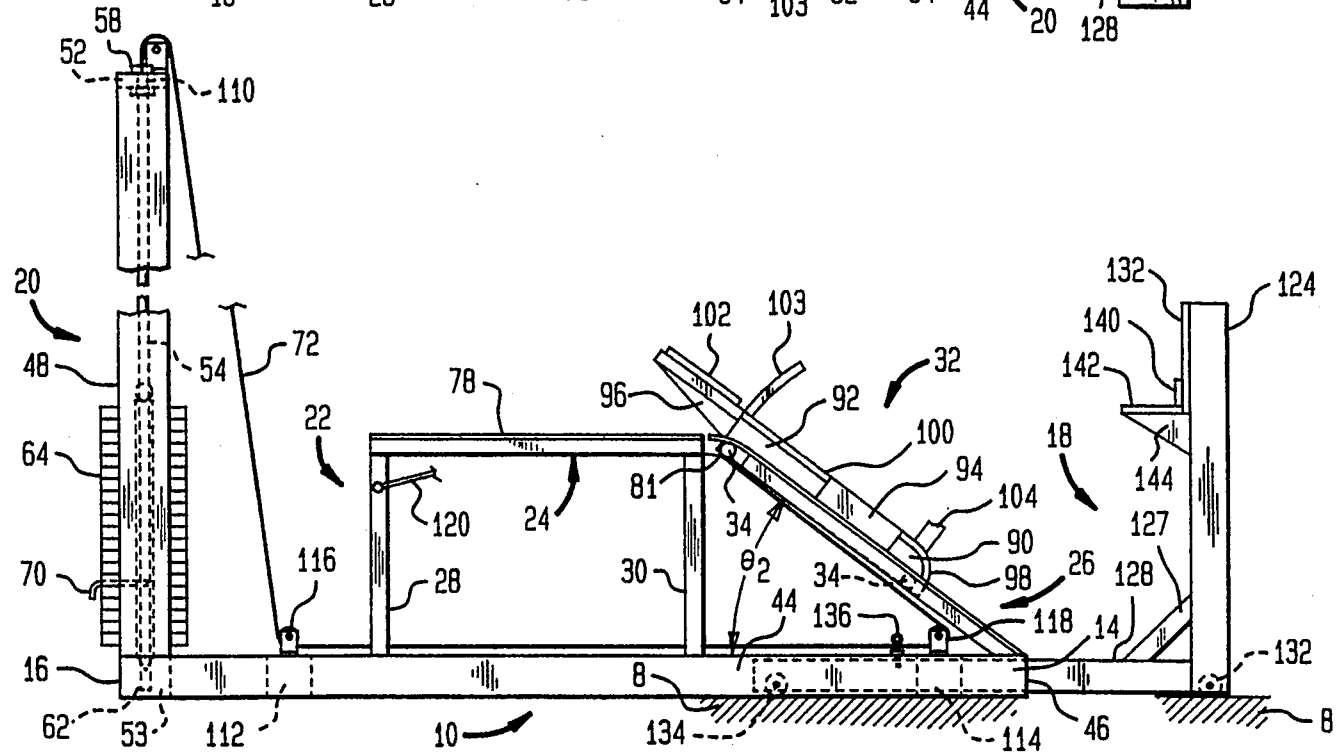
Figure 6:
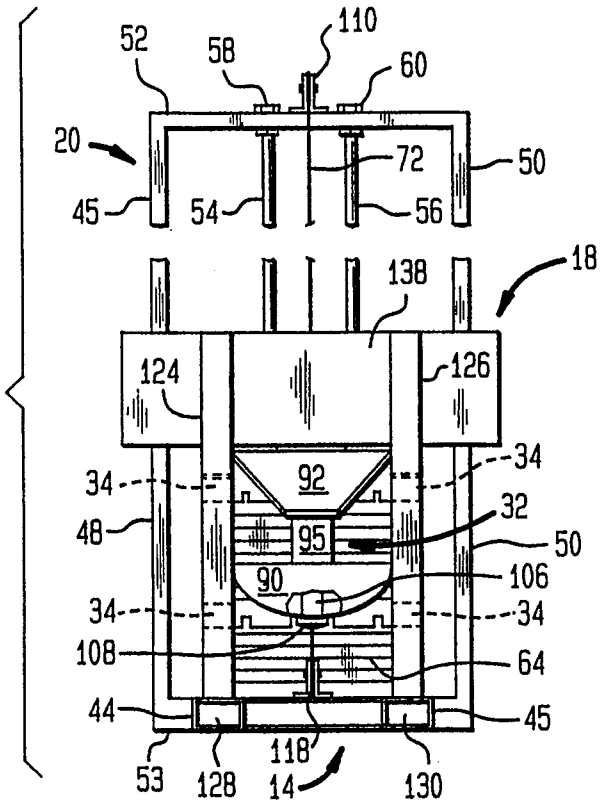

With reference now to FIGS. 5, 6 and 7, base frame 10 includes a pair of elongated horizontally disposed channel members 44 and 45 extending rearwardly in parallel spaced relation. Members 44 and 45 are supported on supporting surface 8 and have open ends 46 and 47, respectively, at front end 14 of base frame 10. Members 44 and 45 are mounted at rear end 16 of base frame 10 to weight rack 20.

Weight rack 20 includes a pair of elongated vertically disposed tube members 48 and 50 extending upwardly in parallel spaced relation. An upper cross-bar 52 extends across the tops of tube members 48 and 50 and a lower cross-bar 53 extends across the bottoms of said members.

A pair of elongated vertically disposed guide bars 54 and 56 extend upwardly in parallel spaced relation symmetrically between tube members 48 and 50. Guide bars 54 and 56 are secured to upper cross-bar 52 via nuts or the like 58 and 60, respectively, and are received in detents such as 62 in lower cross-bar 53. Guide bars 54 and 56 support a plurality of weights in a weight stack 64 so that the weights slide up and down the guide bars when the apparatus of the invention is used by an exerciser as will hereinafter be discerned.

Figure 8:
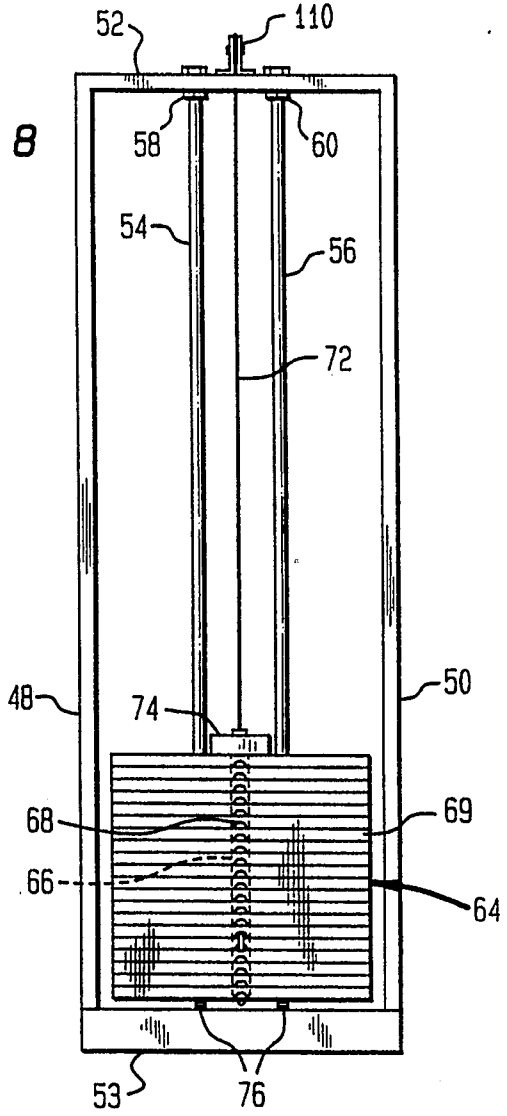
FIG. 8 is a diagrammatic end view representation best illustrating a weighting arrangement according to the invention.

Reference will now be made to FIG. 8 which best describes the weighting arrangement referred to above. Thus, a bar 66 extends through the center of each of the plurality of weights in weight stack 64. Bar 66 has a plurality of holes such as 68 disposed along its length. Each of the holes 68 corresponds in position to the position of a weight such as 69 in weight stack 64. Desired weights in weight stack 64, and which weights are in the form of plates, are selected by inserting a selector pin 70 (FIG. 5) in a selected hole 68, whereby the selected weight and all of the weights thereabove are lifted by a chain 72 coupled to the uppermost weight in stack 64 by a coupling member 74. Thus, the exerciser can gradually increase or decrease the amount of weight lifted when performing the squat exercise, as will now be appreciated.

Resilient shock absorbing members 76 are disposed between the lowermost weight in weight stack 64 and lower cross-bar 53 to lesson the impact when the weights are lowered, as may be the case.

With further reference to FIGS. 5, 6 and 7, horizontal section 24 of track frame 22 includes a pair of elongated, horizontally disposed track members 78 and 80 in parallel spaced relation. A cross-bar 82 ends across the rear ends of track members 78 and 80 and a cross-bar 84 extends across the front ends thereof.

Inclined section 26 of track frame 22 includes a pair of elongated disposed track members 86 and 88 in parallel spaced relation. Track members 86 and 88 curve away from the front ends of track members 78 and 80, respectively, as at a curved track portion 81 and extend angularly downward at angle $\Theta_2$ (approximately 35 degrees) to channel members 44 and 45 of base frame 10. Curved portion 81 has a radius of approximately three inches.

With continued reference to FIGS. 5, 6 and 7, carriage 32 includes exerciser body support members 90 and 92, a connecting member 94 and a headrest 96. Suitable pads 98, 100 and 102 (FIG. 5) cover body support members 90, 92 and headrest 96, respectively. Shoulder bars 103 are secured to body support member 92 and a belt 104 is secured to body support member 90. Carriage 32 rides in track members 86 and 88 of track frame 22 via four rollers 34, two on each side of the carriage, one in the front and another in the back thereof.

Body support member 90 is adjustable away from and toward body member 92 along connecting member 94 via a screw thread arrangement 106 actuated by a knob 108 as particularly shown in FIG. 6.

Chain 72 is secured to weight bar 66 (FIG. 8) and is coupled to upper cross-bar 52 via a chain sprocket support 110 disposed between base frame guide bars 54 and 56, and to a rear cross-bar 112 and a front cross-bar 114 coupling channel members 44 and 45 via chain sprocket supports 116 and 118, respectively. Chain sprocket supports 116 and 118 are aligned with chain sprocket support 110 as particularly shown in FIG. 7. Chain 72 is secured to carriage 32 by suitable mechanical means (not otherwise shown) as will be discerned from FIGS. 5, 6 and 7. With the arrangement shown and described, chain 72 is effective for raising and lowering selected weights in weight stack 64 upon carriage 32 being displaced along track members 78, 80 and 86, 88.

A restraining cable 120 is secured to cross-bar 82 of horizontal section 24 of track frame 22 as at 122 (FIG. 7) and is secured to the bottom of carriage 32 by suitable mechanical means (not otherwise shown). The purpose of restraining cable 120 will be hereinafter further explained.

With still further reference to FIGS. 5, 6 and 7, foot plate frame 18 includes a pair of elongated vertically disposed bars 124 and 126 extending upwardly in parallel spaced relation. Bars 124 and 126 are secured, respectively, to elongated rearwardly extending horizontally disposed bars 128 and 130 which extend in parallel spaced relation. Bars 128 and 130, braced to bars 124 and 126 via bracing members such as 127 (FIG. 5) are received in open ends 46 and 47 of base frame members 44 and 45.

Bars 128 and 130 are supported on supporting surface 8 via rollers 132 (external) and 134 (internal) as shown in FIG. 5 so as to telescope inwardly and outwardly of base frame members 44 and 45. Bars 128 and 130 are locked in a desired telescoped position via pins such as 136 engaging appropriate apertures or detents (not otherwise shown) in bars 128 and 130.

Bars 124 and 126 support a foot plate 138. A heel plate 140, a foot rest 142 and a foot rest support 144 are supported by foot plate 138 as particularly shown in FIG. 5.

In using the invention, exerciser 2 first selects a "warmup" weight from weight stack 64 via selector pin 70. Carriage 32 is at a "start" position on inclined section 26 of track frame 22 (FIG. 4). The back of exerciser 2 is disposed on carriage 32 so that shoulder rests 102 rest on the exerciser's shoulders and support members 90 and 92 fit comfortably along the curve of the exerciser's lower back, with the exerciser's head resting on headrest 96. The position of support member 90 is adjusted via knob 98 for this purpose. Strap 104 is used to snugly strap the exerciser on the carriage.

The position of foot plate frame 18 is next adjusted in the start position. The feet are placed flat on foot plate 138. The foot plate frame is telescoped in or out of base frame 12 until the thighs of exerciser 2 are perpendicular to supporting surface 8 (FIG. 4). Locking pins 136 lock the foot plate frame in the desired position.

Exerciser 2 pushes with his/her legs against the locked foot plate frame so that carriage 32 rides upwardly along angled section 26 and then along horizontal section 24 of track frame 22 as the selected weights are lifted via cable 72.

When exerciser 2 is in the position shown in FIG. 2, i.e. substantially horizontal, carriage 32 is allowed to move forward by the exerciser ceasing to push thereby causing the tension on cable 72 due to the weights carried by the cable to be released. Upon reaching the position shown in FIG. 4, the exerciser again pushes against foot plate frame 18 to begin another exercise cycle.

Carriage 32 will not roll all the way down inclined section 26 of track frame 22 due to restraining cable 120 arranged as aforenoted. The arrangement is such that rear rollers 34 will not go around the curve at 90 but will be restrained in the position shown in FIG. 4. This arrangement prevents serious injury which can otherwise occur when using free weights as in the present case.

There has thus been described apparatus for duplicating an exerciser's movements when otherwise performing the squat exercise. The invention duplicates the squat exercise but with the exerciser in a horizontal position rather than in a vertical position, as the exercise has been heretofore performed.

The present apparatus has particular advantages in that the risk of injury to the back and knees is greatly reduced because the exerciser's back is supported and it is not necessary to try to balance the weights, or to avoid tripping on an object while trying to put the weights back on a rack as has otherwise been necessary. Further, the exerciser need not be concerned about being stuck in the squat position illustrated in FIG. 1C.

The apparatus of the invention differs from other apparatus for performing like exercises in that it does not permit the exerciser's back to remain straight but, rather, allows the exerciser's back to increase in angularity as the exercise is being performed. The advantage of apparatus of the type described will be readily appreciated.

With the above description of the invention in mind, reference is made to the claims appended hereto for a definition of the scope of the invention.

What is claimed is:

1. Squat exercise apparatus, comprising:

a substantially horizontally disposed base frame having a front end and a rear end, said frame supported on a supporting surface;

a substantially vertically disposed foot plate frame displaceably supported by the base frame at the front end of said base frame, and displaceable away from and toward said front end;

means for locking said foot plate frame to said base frame in a selected displaced position;

a substantially vertically disposed weight rack fixedly supported by the base frame at the rear end of said base frame, said weight rack carrying a plurality of selectable weights;

means for selecting weights from said plurality of selectable weights;

a track frame supported by the base frame between said front and rear ends of said base frame, said track frame including first substantially horizontal track and second track inclined downwardly from the first track toward the front end of the base frame;

carriage means for supporting an exerciser, and disposed on the track frame so as to be displaceable along said first and second tracks, so that said carriage means is displaceable first upwardly along said second track and then rearwardly along said first track upon the exerciser pushing with his/her feet against the foot plate frame; and means for coupling the plurality of weights to the carriage means so that the selected weights of said plurality of weights are lifted upon said exerciser pushing with his/her feet against said foot plate frame for displacing said carriage.

2. Apparatus as described by claim 1, wherein:

the second track inclines downwardly from the first track at an angle of approximately 35 degrees.

3. Apparatus as described by claim 2, including:

a curved track section joining the first track and the second track so that the second track inclines downwardly from the first track at the angle of approximately 35 degrees.

4. Apparatus as described by claim 3, wherein:

the curved track section is curved at a radius of approximately 3 inches.

5. Apparatus as described by claim 1, wherein:

the means for coupling the plurality of weights to the carriage means has means for lowering the selected weights of said plurality of weights when the exerciser ceases pushing with his/her feet against the foot plate frame, whereupon the carriage means is displaced first forwardly along said first track and then downwardly along said second track.

6. Apparatus as described by claim 3, including:

means coupled to the track frame and to the carriage means for restraining the displacement of the carriage means downwardly along said second track so that a rearward section of the carriage means is restrained from being displaced around the curved track section.

7. Apparatus as described by claim 1, including:

the substantially horizontally disposed base frame having a pair of elongated horizontally disposed channel members extending rearwardly in parallel spaced relation, said channel members being open at the front end of the base frame;

the substantially vertically disposed foot plate frame having a pair of elongated horizontally disposed bar members extending rearwardly in parallel spaced relation corresponding to the spaced relation of the base frame channel members; and the bar members engaging the channel members in telescoping relation, whereby the foot plate frame is displaceably supported by the front end of the base frame and is displaceable away from and toward said front end.

8. Apparatus as described by claim 7, including:

each of the pair of elongated horizontally disposed bar members of the substantially vertically disposed foot plate frame includes first roller means carried by a free end of said bar members and second roller means carried by an opposite end of said bar members;

the first roller means disposed inside the channel members when the bar members engage said channel members in telescoping relation; and the second roller means disposed outside the channel members and engaging the supporting surface.

9. Apparatus as described by claim 1, wherein the means for coupling the plurality of weights to the carriage means includes:

said plurality of weights arranged in a stack;

a chain;

means for affixing one end of the chain to the uppermost weight in the stack;

said chain extending upward from the stack to the top of the weight rack;

means for movably coupling the chain to the top of the weight rack;

said chain extending downward from the top of the weight rack to the substantially horizontally disposed base frame;

means for movably coupling the chain to said base frame at the rear and front ends thereof;

said chain extending from the front end of the base frame to the carriage; and the opposite end of the chain affixed to the carriage.

10. Apparatus as described by claim 9, wherein the means for selecting weights from said plurality of selectable weights includes:

a selector bar extending through the center of each of the plurality of weights in the stack;

said selector bar having a plurality of holes disposed along its length, with each of the holes corresponding in position to the position of a weight in the stack; and a selector pin inserted in a selected hole of the plurality of holes, whereby the weight corresponding in position to the selected hole and all of the weights thereabove are lifted upon said exerciser pushing with his/her feet against said foot plate frame for displacing said carriage.

11. Apparatus as described by claim 1, wherein the carriage means includes:

a forward exerciser body support member;

a rearward exerciser body support member;

an exerciser head rest extending rearwardly of the rearward body support member;

a connecting member connecting the forward body support member to the rearward body support member in spaced relation;

means arranged with the forward body support member and the connecting means for displacing the forward body support member along said connecting means to adjust the spaced relation of the forward body support member and the rearward body support member commensurate with the exerciser's comfort.

12. Apparatus as described by claim 11, including:

a pair of shoulder rest means for the exerciser's shoulders, each of which is disposed on a side of the rearward exerciser body support member.

13. Apparatus as described by claim 11, including:

strap means secured to the forward exerciser body support member for strapping the exerciser on the carriage.

* * * * *